US006021097A

United States Patent [19]

Kanno et al.

[11] Patent Number: 6,021,097

[45] Date of Patent: Feb. 1, 2000

[54] ELECTRONIC WATCH PROVIDED WITH AN ELECTRICAL GENERATOR

[75] Inventors: Fumio Kanno; Kenji Miyasaka; Kohichi Satoh; Kiyotaka Igarashi; Haruhiko Higuchi, all of Tokyo, Japan

[73] Assignee: Citizen Watch Company, Ltd., Tokyo, Japan

[21] Appl. No.: 09/180,614

[22] PCT Filed: Mar. 17, 1998

[86] PCT No.: PCT/JP98/01120

§ 371 Date: Nov. 12, 1998

§ 102(e) Date: Nov. 12, 1998

[87] PCT Pub. No.: WO98/41906

PCT Pub. Date: Sep. 24, 1998

[30] Foreign Application Priority Data

Mar. 17, 1997 [JP] Japan ..... 9-062869
Mar. 5, 1998 [JP] Japan ..... 10-053023

[51] Int. Cl.[7] ..... G04C 23/00; G04C 3/00; G04B 1/00; G04F 5/00

[52] U.S. Cl. ..... 368/64; 368/157; 368/204

[58] Field of Search ..... 368/80, 157, 160, 368/64, 203–204; 318/696

[56] References Cited

U.S. PATENT DOCUMENTS 4,321,521 3/1982 Ueda et al. ..... 368/202
5,038,329 8/1991 Kaliamura et al. ..... 368/157
5,774,426 6/1998 Tu et al. ..... 368/157
5,889,734 3/1999 Sato ..... 368/64

FOREIGN PATENT DOCUMENTS 55-87076 7/1980 Japan .
3-40727 2/1991 Japan .
7-306274 11/1995 Japan .
9-105786 4/1997 Japan .

*Primary Examiner*—Vit Miska
*Attorney, Agent, or Firm*—Greer, Burns & Crain, Ltd

[57] ABSTRACT

An analog-type electronic watch with an electrical generating apparatus, this watch having a load compensation function means, and completing avoiding the adverse influence of magnetic noise which accompanying electrical generation operation. This watch has an electrical generator which operates intermittently, an electrical generation detection means which detects electrical generation by the electrical generator based on a prescribed relationship to the operation of a drive judging means, and a control means which, when the driving judging means detects electrical generation by the electrical generator, supplies a compensation drive pulse to a drive circuit, regardless of the judgment results of the driving judging means.

19 Claims, 9 Drawing Sheets a NORMAL DRIVE PULSE
b COMPENSATION DRIVE PULSE
c DRIVE COIL OPEN/CLOSE SIGNAL
d ELECTRICAL GENERATION NOISE DETECTION TIMING SIGNAL
e INDUCED VOLTAGE SIGNAL
f ROTOR MOVEMENT INFORMATION
g GATE OPEN/CLOSE SIGNAL
h GENERATED VOLTAGE SIGNAL
i ELECTRICAL GENERATION DETECTING SIGNAL

1ms
3/4ms
1 second
1 second
5ms
12h
32ms
10ms
6ms
P1
P2
P3
FP
(a)
(b)
(c)
(d)
(e)
(f)
(g)

ELECTRONIC WATCH PROVIDED WITH AN ELECTRICAL GENERATOR

FIELD OF THE INVENTION

The present invention relates to an analog electronic watch that has a electrical generator with a load-compensation function.

BACKGROUND

The first background art is as follows.

An analog watch that has a load-compensation function, this watch having a stepping motor that is driven by drive pulses, a drive judging means that observes movement of a rotor after a normal drive pulse is applied to the stepping motor and judges whether or not drive was correctly done, and a compensation drive pulse supplying means which, if the judgment was made by the drive judging means that drive was not completely done, supplies a compensation drive pulse to a drive circuit, is already known in the form of a product.

The principle of the load-compensation function is that of performing hand drive at each step with a drive pulse that has an amount of energy that is close to the minimum required energy, and observing the waveform of the electromotive voltage generated in the drive coil by means of the movement of the thus-driven rotor.

If a characteristic waveform is detected, such as occurs when the rotor is not capable of rotating normally through one step, this occurring during drive of the calendar mechanism, and when attached dirt or the like place a suddenly increased load, a compensation pulse having a larger energy (for example, with a larger time width) is immediately supplied once again so that the rotor is reliably driven by one step.

By doing this, the average power consumption from the drive pulses is reduced, so as to lengthen the life of the battery, and misoperation (delay) of the watch is eliminated.

The above-noted technology is already widely applied in electronic watches.

One known publication that discloses this technology is, for example, the Japanese Examined Patent Publication (KOKOKU) No. 8-33457.

In the embodiment shown in FIG. 1 of the above-noted publication (FIG. 6 in this application), a first drive inverter 18, a second drive inverter 19, and the associated circuitry form a stepping motor drive circuit, while a coil open/close pulse supplying means 20, a detection circuit 31, a first rotation detection signal storage circuit 32, a second rotation detection signal storage circuit 33, and the associated circuitry form a drive judging means. A compensation pulse supplying means 50 is also provided.

The stepping motor in the above-noted background art is configured as shown in FIG. 2 (FIG. 7 of this application).

Let us examine the load compensation technology as presented in the above-noted publication. As shown in FIG. 5 of the above-noted publication (FIG. 8 of this application), a voltage pulse having an overall width of 5 ms and which is finally broken up is supplied alternately every 1 second to the ends of the drive coil 28 of a two pole stepping motor as the normal drive pulse.

Each time the rotor 29, which is formed by a permanent magnet, is driven, it does not stop immediately when the drive pulse stops, but rather exhibits free vibration several times, this vibration inducing a voltage in the coil 28.

The waveform thereof naturally reflects the movement condition of the rotor 29, and in the case in which the rotor has completed a feed operation of one step normally, a coil current waveform such as shown in FIG. 4 (FIG. 9 of this application) is obtained.

However, if the gear train load is large, so that the rotor could not rotate normally, a coil current waveform such as shown in FIG. 7 (FIG. 10 of this application) is obtained.

In the case in which the normal drive pulse just barely results in normal rotation, a coil current waveform such as shown in FIG. 10 (FIG. 11 of this application) is obtained.

To observe the voltages waves induced by rotor movement that cause these currents, it is necessary during the free vibration of the rotor, to ground one end of the coil and to continuously or intermittently observe the voltage appearing on the other end, which is left open.

Because of the above, using a coil open/close signal (a narrow pulse that controls the inverter of the drive circuit, this being generated continuously, for example, 1 ms after the completion of the normal drive a predetermined number of times, for example, 13 times, at a 1-ms interval (as shown in FIG. 3 (*d*), FIG. 12 (*d*) of this application)), one of the end of the coil 28 is opened intermittently, the induced voltage appearing when that occurs (which is amplified as a result of a sudden change in the impedance) being detected by the detection circuit 31.

In the case of normal rotation, as shown in FIG. 4 (FIG. 9 of this application), because the induced voltage exceeds a threshold value (Vth) of the detection circuit on same times, the first rotation detection signal storage circuit 32 maintains its condition, after which a switch is made to the detection of the induced electromotive voltage at the other end of the coil.

Additionally, when the induced electromotive voltage exceeds the threshold value of the detection circuit on some time, the second rotation detection signal storage circuit 33 (which operates by counter 34 for only a short time) holds that condition.

If both the first and the second rotation detection signal storage circuits store an induced electromotive voltage that exceeds the threshold value, because the compensation drive pulse (FIG. 3 (*c*); FIG. 12 (*c*) in this application) that is generated when the subsequent free vibration of the rotor comes to rest need no longer be supplied to the drive circuit, gates are closed to block this. The circuitry transitions to a condition in preparation for drive judgment of the next normal drive.

In the case in which a feed error occurs as shown in FIG. 7 (FIG. 10 of this application) in the background art, after normal drive although the detection of an induced electromotive voltage that exceeds the threshold value is stored in the first rotation detection signal storage circuit 32, the second rotation detection signal storage circuit 33 maintains its condition even up until the last coil open/close signal and never stores the same condition in which an induced electromotive voltage exceeds the threshold value, as mentioned above.

In this case, a compensation drive pulse is applied to the same drive inverter as for normal drive. The overall width of the compensation drive pulse exceeds twice the width of the normal drive pulse, so that the stepping motor is supplied a sufficient amount of energy as drive is performed again, thereby making up for the delay caused by the missed drive.

In case in which, in the background art, normal rotation just barely occurs as shown in FIG. 10 (FIG. 11 in this application), after normal drive, at quite late a point in time the first rotation detection signal storage circuit 32 stores the detection of an induced electromotive voltage that exceeds the threshold value. The switched second rotation detection signal storage circuit 33 ultimately becomes the same at end of the operating period.

Because both detection signal storage circuits have operated, the supply of a compensation drive pulse is blocked.

The reason that the two detection signal storage circuits are switched sequentially in the background art is to improve the accuracy of judging drive, in consideration of the fact that the swing of the free vibration of the rotor is in both directions, so that the induced electromotive voltage appears sequentially as positive and negative.

The second background art will now be described. The principle thereof was known at the time of the inception of quartz-type electronic watches, but has come to be used in products starting several years ago. This is the so-called self-winding electric generating technology.

FIG. 3 in this application is a plan view of an example of a wristwatch that is an embodiment of the present invention.

Since FIG. 2 can also be used for explaining a plan-view arrangement of the background art in which two stepping motors are arranged, the background art will be described using the example of FIG. 3.

When an eccentric weight 14, which is pivotally supported within the wristwatch is rotated by either gravity or the movement of the art, this rotation is amplified by the gear train 15, and a rotor 12 of an ultra-compact electrical generator 10 is rotated at high speed, this causing generation of electricity in a coil 11.

The structure of the coil 11, the rotor 12, and a stator 13 of the electrical generator 10 are almost entirely the same as or similar to the structure of a stepping motor formed from a two-pole permanent magnet.

The materials, dimensions and coil specifications of the above-noted stepping motor for the electrical generator are selected appropriately so as to achieve the required electrical generating capacity, and so that housing within the wristwatch module is possible.

In terms of the details of a specific example of the placement condition between the stepping motor and the generator mechanism in the above-noted example, although a detailed drawing is not shown, in the case of a configuration with an electrical generator 1 and one stepping motor 6, as shown in FIG. 1, it is desirable that the two coils, which are parts having a large thickness within the round module, be arranged on both sides of the center of the watch, so that they form an approximate V shape. (Upon first view, this resembles a double-motor multifunction watch arrangement of the past. There is a round secondary cell located at the opening of the V shape.)

Additionally, as shown in FIG. 3, within the round module, are disposed two stepping motors 61 and 62, these being disposed at the sides of the watch's center axis, which joins the electrical generator 10 and the secondary cell 31.

In both of the examples cited, the rotor diameter and coil length of the electrical generator 10 are less than twice that of stepping motors 61 and 62, but compared alone, the amount of surface area occupied by the electrical generator 10 is greater.

The electricity generated by the rotation of the rotor 12 caused by arm movement is alternating current, and the voltage thereof is irregular with respect to time. This non-time-constant generated AC current is rectified and charges a secondary cell 31 or large-capacitance capacitor, this being consumed in steady-state fashion a little amount at a time as energy to operate the watch mechanism.

In the above-noted self-winding watch mechanism as well, it is desirable that the steady-state power consumption to operate the watch mechanism be small, as this enables the eccentric weight 14 and electrical generator 10, and thereby the overall watch, to be made small, and enables some extension of the operating life in the condition in which the watch has been removed from the wrist (this normally being several days).

With respect to these requirements, an extremely desirable power-saving technology that is highly effective is use in combination with the load-compensation function that is described above as the first background art.

Merely combining the first and second background arts, however, results in a problem, which is the magnetic noise generated by the generation of electricity causes misoperation of the drive judging means of the load compensation function.

Specifically, when the rotor 12 of the electrical generator 1 (10) rotates at high speed intermittently with irregularity, an alternating magnetic flux is generated in the magnetic circuit of the electrical generator 1 (10), part of which leaks and enters the magnetic circuit of the stepping motor 6 (or 61 and 62), so that an electromotive voltage is induced in the drive coils of the stepping motor 6 (or 61 and 62).

While this induction action is not to a degree that directly influences the rotational movement of the stepping motor 61 (or 61 and 62), if it occurs at a time with a bad timing when there is much induced electromotive voltage noise caused by the electrical generation when the drive judging means of the load compensation function is operating, because it is not possible to distinguish this with respect to induced electromotive voltage cause by free vibration of the rotor of the stepping motor 6 (or 61 and 62), it is not possible to avoid the danger that even if the rotor is not feed by 1 step, a judgment could be made that feed was done, so that the compensation drive pulse b which is actually required is not supplied.

According to experiments, over a practically usable eccentric weight rpm range (for example, 120 to 250 rpm), there is generation in the frequency range from 167 to 333 Hz, with a single-ended amplitude of 50 mV or greater, and when the weight free-falls, there is generation of induced voltage noise at 175 Hz at a level of 1 V or greater, this being a level that could not possibly be neglected.

There is also technology that appears to be applicable in solving this drawback. This will be described below as the third background art.

Specifically, the above-noted technology is disclosed in the publicly known Japanese Examined Patent Publication (KOKOKU) Nos. 61-28313 and 61-38423.

The underlying technology is a load compensation technology that is close to the technology of the first background art, this being a drive technology to which is added a function to provide a countermeasure with respect to an external alternating current magnetic field.

If a watch is placed within an external floating AC magnetic field that varies, because the magnetic flux thereof passes through the core of the coil with high density, an induced voltage develops in the coil, this causing misoperation of the drive judging means in the same manner as described with regard to the second background art, thereby hindering the achievement of complete load compensation.

In the third background art, the drive judging means is caused to operate also immediately before each normal drive (since the rotor is still stopped, this being only for the detection of external magnetic noise), and if an induced voltage is detected a normal drive pulse having a pulse widened to a priorly prepared value is supplied so that a feed error does not occur even in the presence of an external magnetic field, the operation of the drive judging means being omitted after drive.

In the case in which an external magnetic field is not detected, after a normal drive the drive judging means is caused to operate, and normal load compensation is performed.

While the above-noted cited references do not mention an application to an self-winding electrical generating watch, in the latter thereof it appears that there is sufficient possibility of such application, since the only difference is that the source of the noise magnetic field is within the watch.

However, a careful investigation reveals that, in a self-winding wristwatch, because of a sudden change in the electrical generation, there is a change in the noise generation condition even before and after the normal drive pulse, so that even if noise is not detected immediately therebefore, there is a frequent risk that noise generated during the immediately following drive judging period will cause misoperation.

Therefore, even the application of the third background art does not enable the achievement of a complete load compensation function.

An object of the present invention is to provide an improvement on the above-noted drawbacks in the background art, by providing a technology for use in an analog-type watch having a load compensation function means and which has an electrical generator capable of generating electricity intermittently, such as shown by examples cited with regard to self-winding electrical generation technology, this technology completing avoiding the influence of magnetic noise which accompanies the electrical generation action, thereby performing failure-free load compensation.

DISCLOSURE OF THE INVENTION

To achieve the above-noted object, the present invention has the following basic technical constitution.

Specifically, in an analog-type watch with an electric generator and which further comprising a load compensation function, having a stepping motor which is driven by a prescribed drive pulse, a drive judging means which observes a movement of a rotor after a normal drive pulse is applied to said stepping motor and which judges whether or not drive was done, and a compensation drive pulse supplying means which, when a judgment is made by said driving judging means that said prescribed drive had not been done, supplies a compensation drive pulse to a drive circuit, the first aspect of the present invention is an analog watch with an electrical generating apparatus, this watch further comprising an electrical generation-time compensation means, which comprises, an electrical generator capable of irregularly intermittent operation, means for detecting electrical generation by said electrical generator, based on a prescribed relationship to operation of said driving judging means, and a control means which, when said electrical generation detection means detects electrical generation by said electrical generator, supplies said compensation drive pulse to said drive circuit, regardless of judgment results of said driving judging means.

The second aspect of the present invention in an analog-type watch with an electric generator and with a load compensation function, having at least two stepping motors that are driven by a prescribed drive pulse, a drive judging means for each of said stepping motors which observes the movement of a rotor after a normal pulse is applied to said stepping motor and which judges whether or not each of the stepping motors was driven, and a compensation drive pulse supplying means which, when a judgment is made by said driving judging means that drive had not been done, supplies a compensation drive pulse to a drive circuit, which corresponds to each one of said step motors, said watch further comprising an electrical generation-time compensation means that has an electrical generator which irregularly operates intermittently, an electrical generation detection means which detects an electrical generation action of said electrical generator based on a prescribed relationship with the operation of said driving judging means, and control means which, when electrical generation operation by said electrical generator is detected by said electrical generation detection means, supplies a compensation drive pulse to said drive circuit, regardless of the judgement resulted from said drive judgement means, wherein said electrical generation detection means is configured so that detection sensitivity with respect to operation of said electrical generator is different between the case of operation based on a prescribed relationship to operation of a specific driving judging means of said drive judging means and operation based on a prescribed relationship to operation of a different driving judging means.

PREFERRED EMBODIMENTS OF THE PRESENT INVENTION

Specific examples of an electronic watch with an electrical generator according to the present invention are described below in detail, with reference being made to accompanying drawings.

Figure 1:
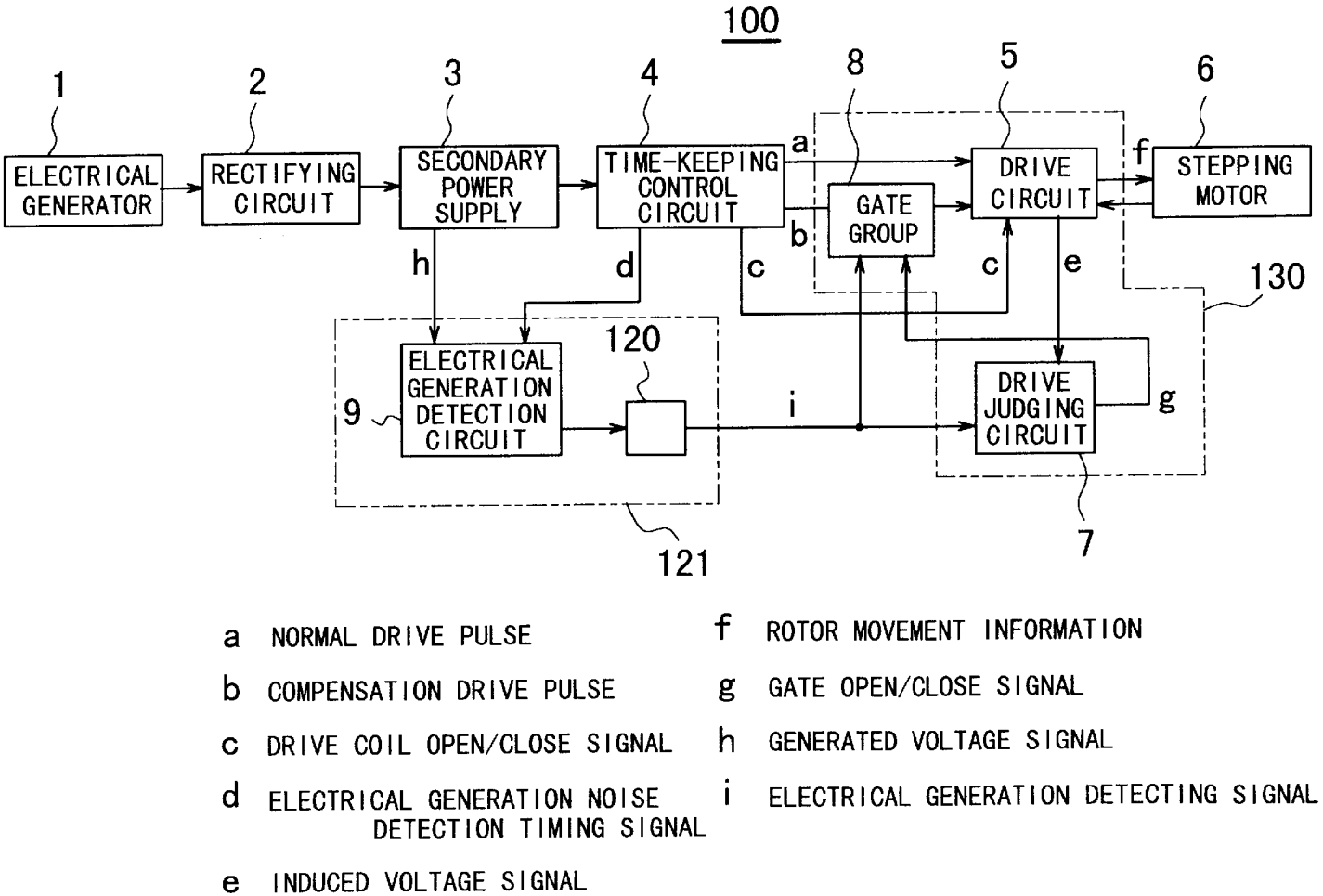
FIG. 1 is a block diagram which illustrates a specific example of an electronic watch with an electrical generator according to the present invention.

FIG. 1 is a block diagram which shows, in simplified form, the configuration of an example of an electronic watch with an electrical generator 100 according to the present invention, in which is shown an analog electronic watch with an electrical generator 100, which has a stepping motor 6 that is driven by a prescribed drive pulse and a load compensation function means 130 that has a drive judging means 7 which observes the movement of a rotor of the stepping motor 6 after application of a normal drive pulse to the stepping motor 6 and which judges whether or not it was driven, and a compensation drive pulse supplying means 8 which, when the above-noted driving judging means 7 judges that a prescribed drive was not made with respect to the rotor of the stepping motor 6, supplies a compensation drive pulse to the drive circuit 5, this watch also having an electrical generator 1 that operates irregularly and intermittently, and a electrical generation-time compensation means 121 that has an electrical generation detection means 9 which detects electrical generation by the electrical generator 1 based on a prescribed relationship with the operation of the driving judging means 7, and a control means 120 which, when electrical generation by the electrical generator 1 is detected by the electrical generation detection means 9, and in response to the results thereof, outputs an electric generation detecting signal i so as to supply a compensation drive pulse to the drive circuit 5, regardless of the judgment results of the driving judging means 7.

Figure 2:
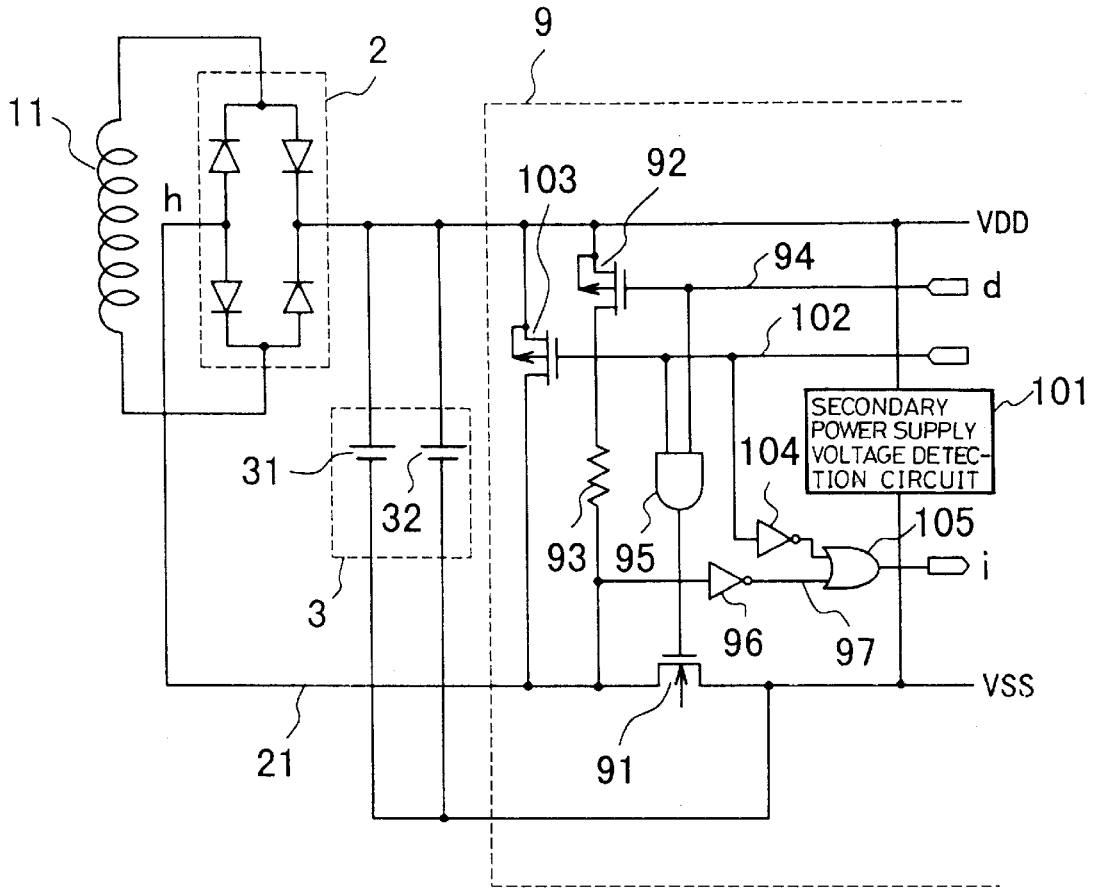
FIG. 2 is a block diagram which illustrates the main part of a specific example of an electronic watch with an electrical generator according to the present invention.

The electronic watch with an electrical generator 100 according to the present invention will be explained in further detail, with reference being made to FIG. 1 and FIG. 2, of which FIG. 1 is a block diagram of an example of an embodiment of the present invention, and FIG. 2 is a detailed circuit diagram of main part thereof.

In FIG. 1, the AC electrical power that is generated by the irregularly and intermittently operating electrical generator 1 is changed to direct current by the rectifying circuit 2, stored in the secondary power supply 3, and consumed by the other circuits and stepping motor drive.

The time-keeping circuit 4, is formed by the combination of a quartz resonator element, a frequency divider, and a logic circuit group, this circuit generating and outputting to the drive circuit 5, the normal drive pulse a for the stepping motor 6, in addition to outputting the compensation drive pulse b, the drive coil open/close signal c, the electrical generation detection timing signal d, and other signals such as a clock pulse which are required for control of circuit operation.

The reference numeral 7 denotes the drive judging means, which makes a judgment as to whether or not normal drive was done, based on the size and a timing of a induced voltage signal e that is generated by the drive circuit 5 which receives operation information f of the rotor of the stepping motor 6, which is operated and controlled by an appropriate clock signal.

In the case in which normal drive was not done, the gate open/close signal g is generated, this operating the compensation drive pulse supply means 8 comprising the gate group, so as to allow supply of the compensation drive pulse b to the drive circuit 5.

The generated voltage signal h from the rectifying circuit 2 is monitored at the electrical generation detection means 9 and, when there is electrical generation during a prescribed period of time according to the electrical generation detection timing signal d, a electrical generation detection signal i is output, this canceling subsequent operation of the drive judging circuit 7, and opening the compensation drive pulse supply means 8 comprising the gate group, so as to allow supply of the compensation drive pulse b.

In a specific circuit, there is no need for each block or signal to be clear separated, and it is possible for these to be intermingled, FIG. 1 being merely a conceptual drawing. The parts that belong to the blocks numbered 5 through 8 are substantially a configuration that falls within the scope of the technology disclosed as the first background art.

FIG. 2 is a drawing that presents an expanded view of the main part of the present invention, this being the part that differs from the background art.

This drawing shows the specific circuit configurations corresponding to the electrical generator 1, the rectifying circuit 2, the secondary cell 3, and the electrical generation detection means 9 which are shown in FIG. 1.

The reference numeral 11 denotes a coil of the electrical generator, the alternating current caused by the rotation of the rotor being converted to a pulsating direct current by the rectifying circuit 2.

The positive voltage side of the DC output is led to the line VDD, and the negative side is led by line 21 to the electric generation detection means 9.

The line 21 passes through a current-limiting transistor 91, which is normally on but which is switched off during discharging and at a timing when detecting electrical generation, and is then connected to the line VSS, a secondary power supply 3 formed by a secondary cell 31 and a capacitor 32 (backup capacitor) which are each connected in parallel between the VDD line and the VSS line being charged thereby.

FIG. 2 also shows some circuitry which is not necessarily directly related to the electrical generation detection means.

Of this circuitry, 101 is a secondary power supply voltage detection circuit, this performing continuous monitoring of the voltage between the lines VDD and VSS. Should the overcharged condition occur, causing a load signal on the line 102, this signal will close the AND gate 95, thereby turning the current-limiting transistor 91 off, which separates the line 21 from the line VSS, thereby stopping new charging, simultaneously with which the transistor 103, which is connected between the line VDD and the line 21 is caused to conduct, thereby causing discharge of the generated electrical power (the output of the rectifying circuit 2).

The secondary power supply 3 quickly leaves the overcharged condition due to normal power consumption, the charging path being restored.

The secondary power supply voltage detection circuit 101 also exists for the purpose of outputting a signal showing a poor charged condition and notifying the user about such condition via a change in the display of the insufficient charge condition.

However, because this technology has already been established in the past, its description will be omitted herein.

Figure 5:
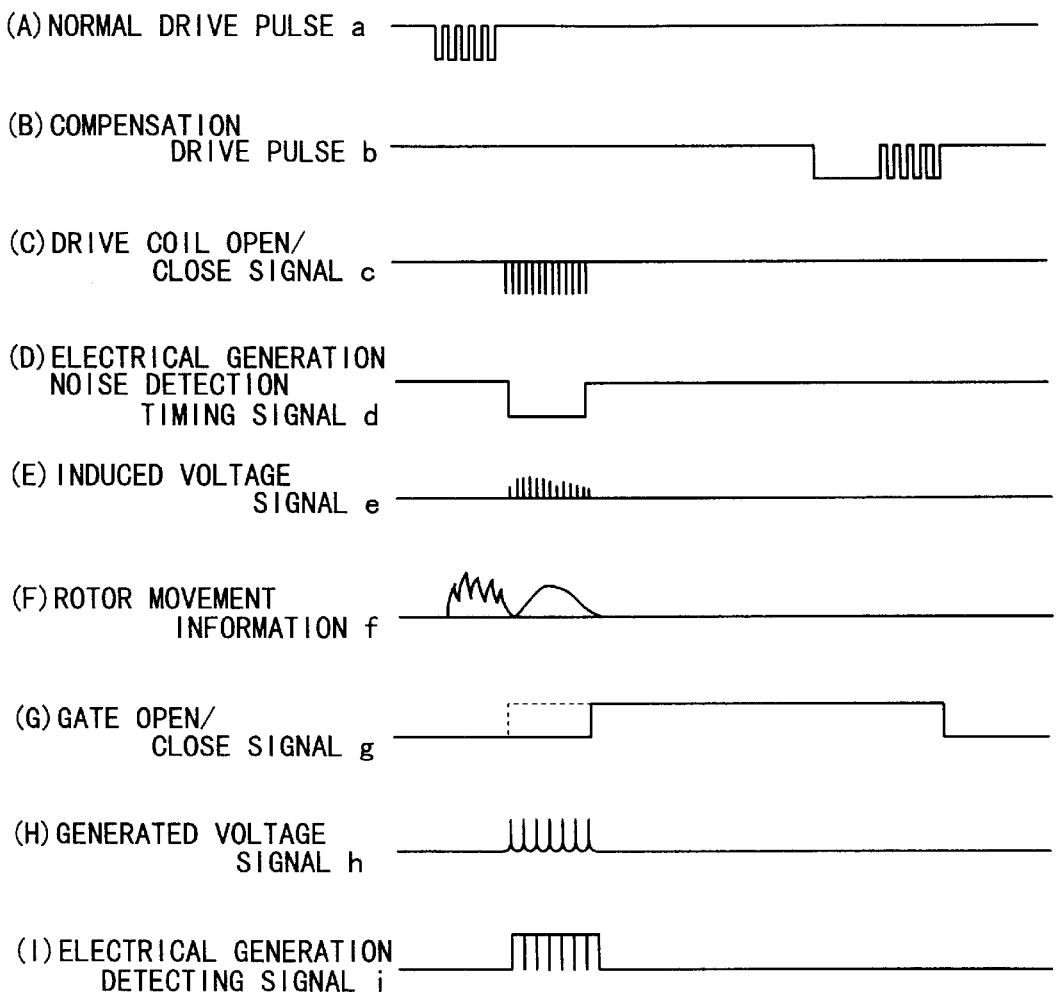
FIG. 5 is a graph which shows the waveforms of various signals that are used in an electronic watch with an electrical generator according to the present invention.
Figure 6:
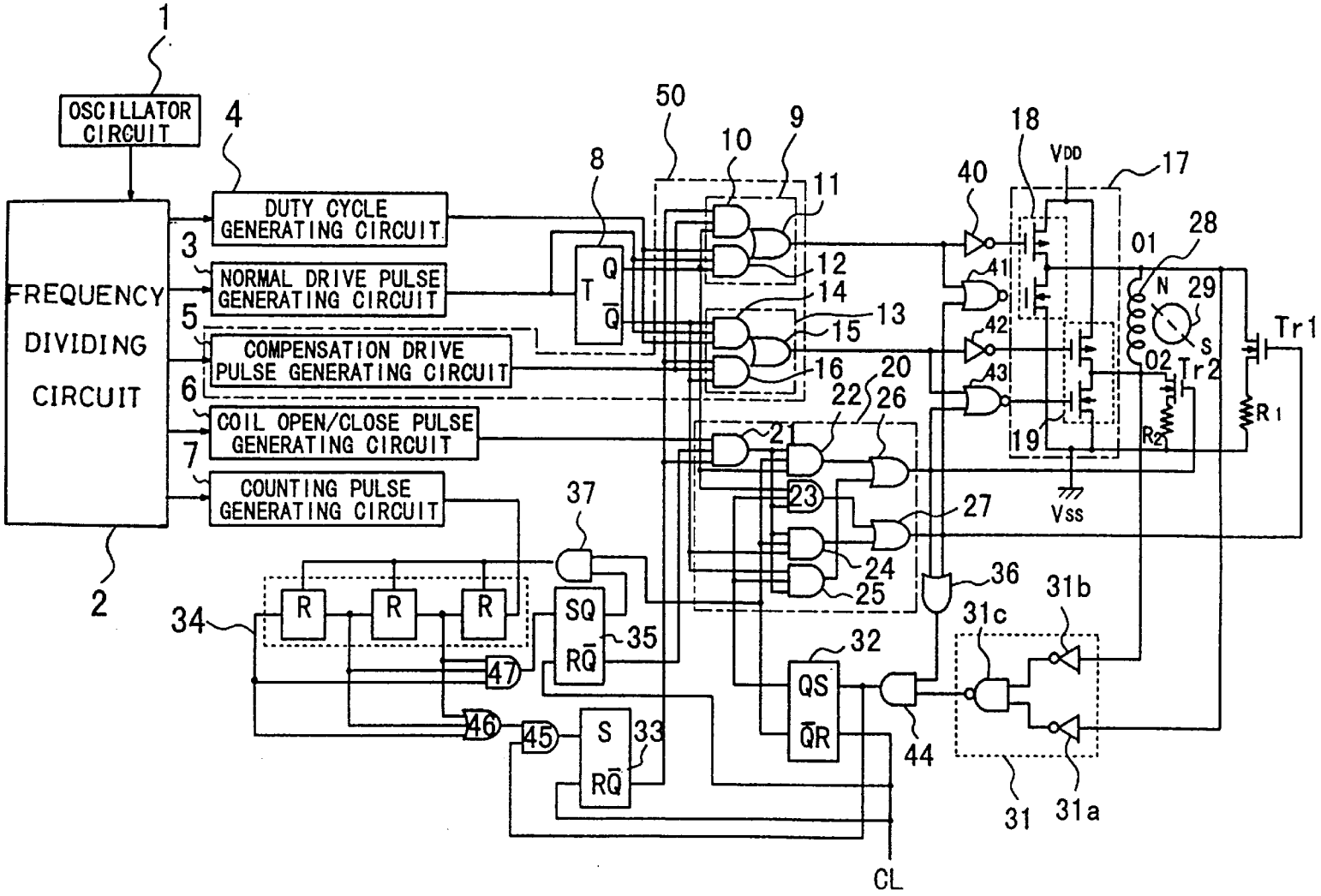
FIG. 6 is a block diagram which shows an example of a control circuit in the background art.
Figure 7:
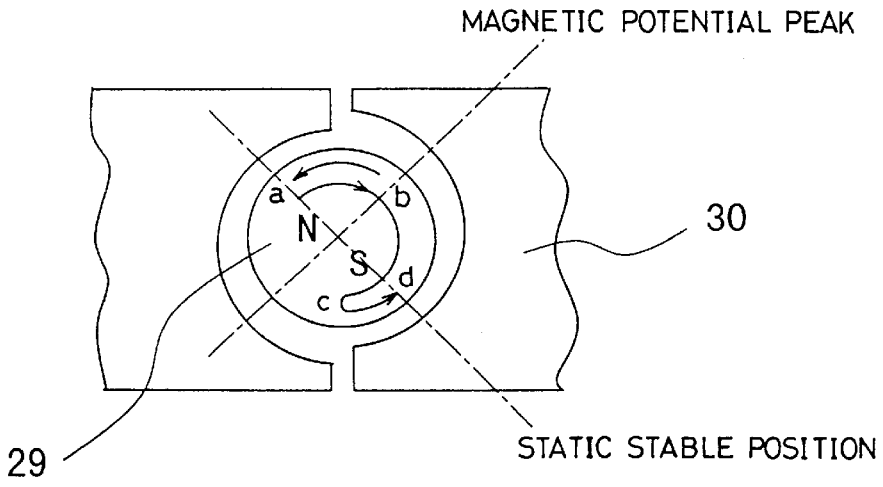
FIG. 7 is a plan view which illustrates in simplified form the configuration of an example of a stepping motor in the background art.
Figure 8:
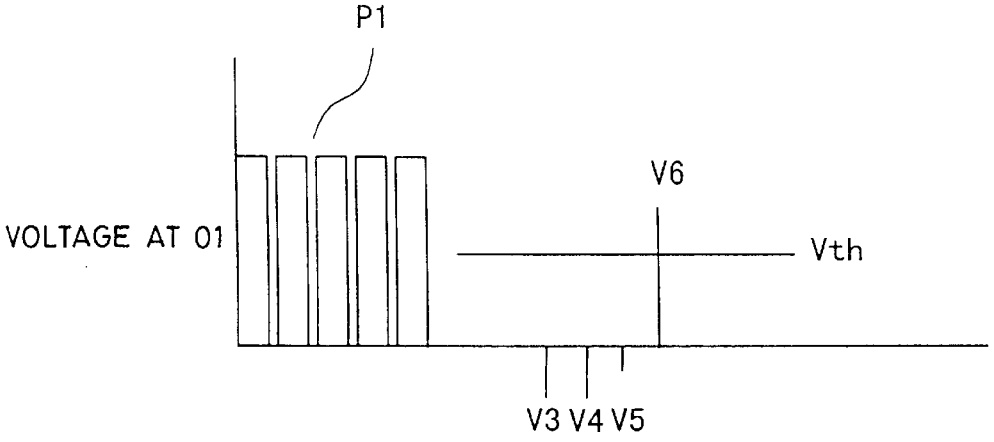
FIG. 8 is a graph which shows an example of the voltage waveform in the background art.
Figure 9:
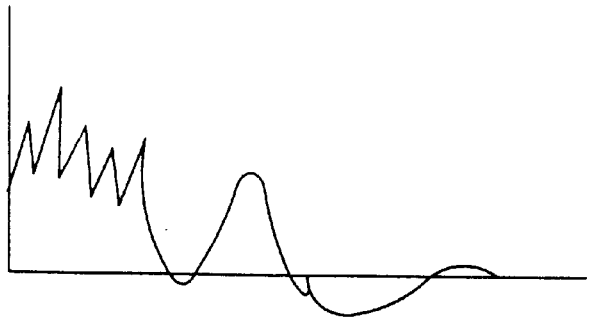
FIG. 9 is a graph which shows the current waveform for the case in which the stepping rotates in the background art.
Figure 10:
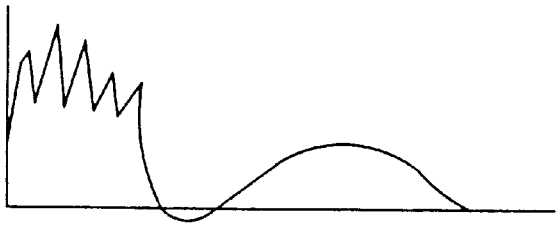
FIG. 10 and FIG. 11 are a graphs which shows the current waveforms for the cases in which the stepping motor does not rotate and in which the stepping motor just barely rotates in the background art.
Figure 11:
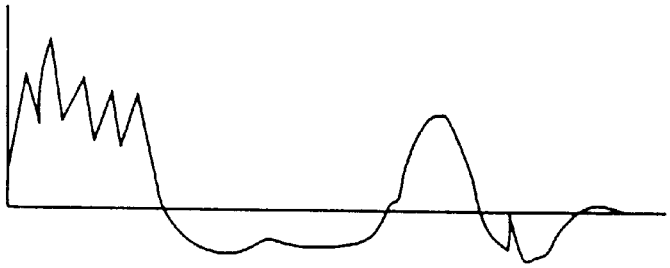

Returning to the main topic of noise detection operation, as is clear from the waveform diagram of FIG. 5 (A), a normal drive pulse a is output from the time-keeping control circuit 4 with a prescribed timing, this causing a rotor of the stepping motor 6 to rotate, a compensation drive pulse b, such as is clear from the waveform diagram of FIG. 5 (B), being output with a predetermined timing that has a prescribed phase difference with respect to the normal drive pulse a.

Additionally, the configuration of the time keeping control circuit 4 can be such that during a prescribed period of time such as shown in FIG. 5 (C), a prescribed number of drive coil open/close signals c are output from the time-keeping control circuit 4, these drive coil open/close signals c controlling the drive circuit 5 and also controlling the drive judging means 7.

In the load compensation function means 130 in the present invention, a single negative pulse (surrounding pulse) such as shown in FIG. 5 (D), which is generated immediately before and so as to cover the drive coil open/close signal c (FIG. 1) which is made up of a multitude of the above-noted strobe pulses generated for the purpose of detecting the free vibration of the rotor of the stepping motor 6 is generated, this being the electrical generation detection timing signal d, this electrical generation detection timing signal d being applied to the line 94.

This signal d closes the AND gate 95 and turns the current-limiting transistor 91 off, thereby separating line 21 from VSS, and also turning a detection resistance control transistor 92 on, so as to check the potential of the rectifying circuit 2 (and therefore the operation of the electrical generator) as a voltage change across the terminals of the detection resistance 93 that is connected in series therewith, this being a check of the generated voltage signal h.

An example of the above-noted generated voltage signal h waveform is shown in FIG. 5 (H).

As a result, a signal that appears at the output line 97 of the detection inverter 96, the input terminal of which is connected to the lower end of the detection resistance 93, is low level when electrical generation does not occur, and high level when electrical generation occurs, the electrical generation detection signal i appearing via the OR gate 105 at the output terminal thereof.

The electrical generation detection signal i is the signal whose waveform is shown in FIG. 5 (I), and if the electrical generation is detected during the period of time in which electrical generation detection timing signal d indicates a negative pulse condition, this signal is output.

In FIG. 5, the waveform (E), as described with regard to the background art, is the induced voltage signal e which judges whether or not the rotor of the stepping motor 6 has rotated normally, and FIG. 5 (E) shows a wave form of this induced voltage signal e for the case in which the rotor did not rotate normally.

In FIG. 5, the waveform (F), as described with regard to the background art, is a voltage signal f that indicates rotor movement information and which is output responsive to the induced voltage signal e waveform.

In the present invention, as described above, in the case in which the above-noted electrical generation detection signal i is generated, as shown in FIG. 5 (G), the gate open/close signal g which opens the gate switching means that is the compensation drive pulse supplying means 8 is forced into the on condition.

That is, in the past in the case in which the voltage signal f, which indicates rotor movement information, indicates that the rotor did not rotate normally, the gate open/close signal g indicated by the solid line in FIG. 5 (G) is output, a compensation drive pulse b passing through the compensation drive pulse supplying means 8 so as to be input to the drive circuit 5 of the stepping motor 6.

In contrast to the above, in the present invention when the electrical generation detection signal i is output, at that point, as indicted by the broken line the gate open/close signal g goes into the forced on condition, a compensation drive pulse b being forcibly input to the drive circuit 5 of the stepping motor 6, regardless of the judgment results of the drive judging means 7.

That is, in the present invention the electrical generation detection signal i not only disable operation of the driving judging means 7, but also supplies a compensation drive pulse b to the drive circuit 5.

When the discharging transistor 103 operates under the overcharged condition, the input of the detection inverter 96 is forcibly set to VDD, the result being that even if the electrical generator 1 generates electricity, the output of the detection inverter 96 is low, so that the judgment is that of no noise.

Because of the above, the negative signal that is generated on line 102 during overcharging is inverted by the inverter 104, and is output as the electrical generation detection signal i via the OR gate 105.

That is, the result is that a compensation drive pulse b is always output when overcharging. Naturally, because of this while the power consumption is large, this causes absolutely no problem, because it occurs in a condition when there is an excess of electrical power.

When the electrical generation detection signal i is present, although even after the rotor is rotated normally by one step, the compensation drive pulse b will be output, the polarity thereof (direction of the current in the coil) is the same as the normal drive pulse a, and because this is in the reverse direction with respect to the next rotation, rather than drive being done, the rotor simply vibrates, so that the condition in which the rotor is excessively fed by the compensation drive pulse b does not occur.

A preferable form of a electronic watch with an electrical generator 40 according to the present invention is for example an electronic watch with an electrical generator 40 which has a stepping motor 6, which is driven by a drive pulse, and a load compensation means 130 that has a drive judging means 7 which observes the movement of a rotor of the stepping motor 6 after application of a normal drive pulse a to the stepping motor 6 and which judges whether or not it was driven, and a compensation drive pulse supplying means 8 which, when the above-noted driving judging means 7 judges that a prescribed drive was not made with respect to the rotor of the stepping motor 6, supplies a compensation drive pulse b to the drive circuit 5, this watching also having an electrical generator 1 that is capable of irregular intermittent operation, an electrical generation detection means 9 which detects electrical generation by the electrical generator 1 based on a prescribed relationship with the operation of the driving judging means 7, and a electrical generation-time compensation means 121, whereby when electrical detection by the electrical generator 1 is detected by the electrical generation detection means 9, a compensation drive pulse b is supplied to the drive circuit 5, giving priority to the judgment made by the driving judging means 7.

The electrical generator 1 in the above-noted example of the present invention can be, for example, an electrical generation means configured so that the vibration of a weight causes the rotation of a prescribed motor, and can also be implemented as an electrical generator that performs generation of electricity by bring coils into proximity with one another so as to cause inductive coupling of electrical energy.

In en electronic watch with an electrical generator 40 according to the present invention, it is preferable that the electrical generation-time compensation means 121 be formed by an electrical generation detection means 9 which detects electrical generation by the electrical generator 1 based on a prescribed relationship with the operation of the driving judging means 7, and a control means 120 which, when the electrical generation detection means 9 detects electrical generation of the electrical generator 1, and in response to the results thereof, generates a electrical generation detection signal i for the purpose of supplying a compensation drive pulse to the drive circuit 5, regardless of the judgment results of the driving judging means 7.

In the above-noted example of the present invention, it is preferable that the output of the output of the control means 120 in the electrical generation-time compensation means 121 control the compensation drive pulse supplying means so that a compensation drive pulse is supplied to the drive circuit, with priority given to the judgment of the driving judging means.

Additionally, in the present invention it is preferable that the operating time period of the electrical generation detection means 9 be almost the same as the operating time period of the driving judging means 7.

In the present invention, it is desirable that the configuration be such that, when the electrical generation detection means 9 detects electrical generation by the electrical generator 1, the electrical generation-time compensation means 121 inputs the electrical generation detection signal i to the driving judging means 7 so that the operation of the driving judging means is stopped.

Additionally, it is desirable in the present invention that by controlling the compensation drive pulse supplying means 8, the electrical generation-time compensation means 121 makes the compensation drive pulse b that is supplied by the load compensation function means 130 and the compensation drive pulse b that is supplied when electrical generation is detected be almost mutually equal.

In the present invention, on example of the electrical generation detection means 9 is configured so that judges whether or not the value of the rectified DC output from the AC voltage generated by the electrical generator 1 exceeds a pre-established threshold value so as to detect the presence or absence of electrical generation by the electrical generator 1.

The above-noted threshold value is a factor that controls sensitivity of electrical generation detection, to be described later, and this value can be adjusted and set to an arbitrary value.

In the specific example of an electrical generation detection means 9 of the present invention, as shown in FIG. 2, the above-noted threshold value is set by means of a balance between the resistance 93 and the resistance of the inverter 96.

Thus, in the electrical generation detection means 9 of the present invention, the sensitivity in detecting the electrical generation by the electrical generator 1 can be set beforehand to a prescribed sensitivity, and this sensitivity can also be made adjustable to an arbitrary value.

The compensation drive pulse supplying means 8 of the present invention is preferably a previously known switching means (not shown in the drawing), this being for example a gate switching means.

The above has been a description of one aspect of the present invention. A variation of an embodiment of the present invention is described below.

The electrical generator is not restricted to the self-winding type, and includes a method which operates irregularly and intermittently and which has the possibility of imparting noise to the load compensation function. For example, it is possible to be electrical generation by induction from the outside of the watch.

There is no need to restrict the details of the technology used for load compensation to those used in the first and third background arts, and it is possible to impart thereto an arbitrary variation.

For example, it is possible to envision the case in which the normal drive pulse, rather than having a fixed width, has a width which is switched in accordance with frequency of occurrences of misfeeds, the case in which a change is made in the condition for judging a normal drive, for example the number of continuous times N exceeding a threshold value, a plurality of compensation drive pulses being made available, compensation drive being performed that differs depending upon, for example, the load condition and noise condition, or depending excessive load or excessive noise, the case in which sharable circuits are partially shared, or in which a programmable microcomputer is used partially or in whole in place of fixed logic circuits. That is, the established background art can be used in accordance with object of the present invention.

By using the above-noted electronic watch with an electrical generator 40 according to the present invention, the electrical generation detection means 9 and driving judging means 7 are caused to operate in parallel, and when electrical generation is detected, a compensation drive pulse is supplied, this resulting in elimination of the possibility of the occurrence of a drive judgment error caused by electrical generation noise, so that a reliable load compensation function is achieved, this not only improving the reliability of the time indication of the watch, but also enabling the achievement of an electronic watch with an electrical generator that is maintained with a reduced power consumption during normal times.

In an electronic watch with an electrical generator 40 according to the present invention, there is no restriction to the use of one stepping motor which is driven by a prescribed drive pulse, this watch being also implementable with a plurality of stepping motors.

For example, it is possible to have one stepping motor for drive of hands that indicate the time and another stepping motor use for, for example, drive of hands for a chronograph display.

An electronic watch with an electrical generator 40 of a different aspect of the present invention, as noted above, will be described in detail below, with reference being made to the accompanying drawings.

This specific example is that of an analog-type watch having a least two stepping motors, each having a load compensation function means, and an electrical generator that is capable of irregular intermittent operation, wherein technology is provided for the purpose of achieving complete avoidance of the adverse influence of magnetic noise accompanying electrical generation, and providing an electronic watch with an electrical generator in which the generation of a compensation drive pulse accompanying the detection of the operation of the electrical generator is suppressed as much as possible, so that wasteful power consumption is minimized.

Figure 3:
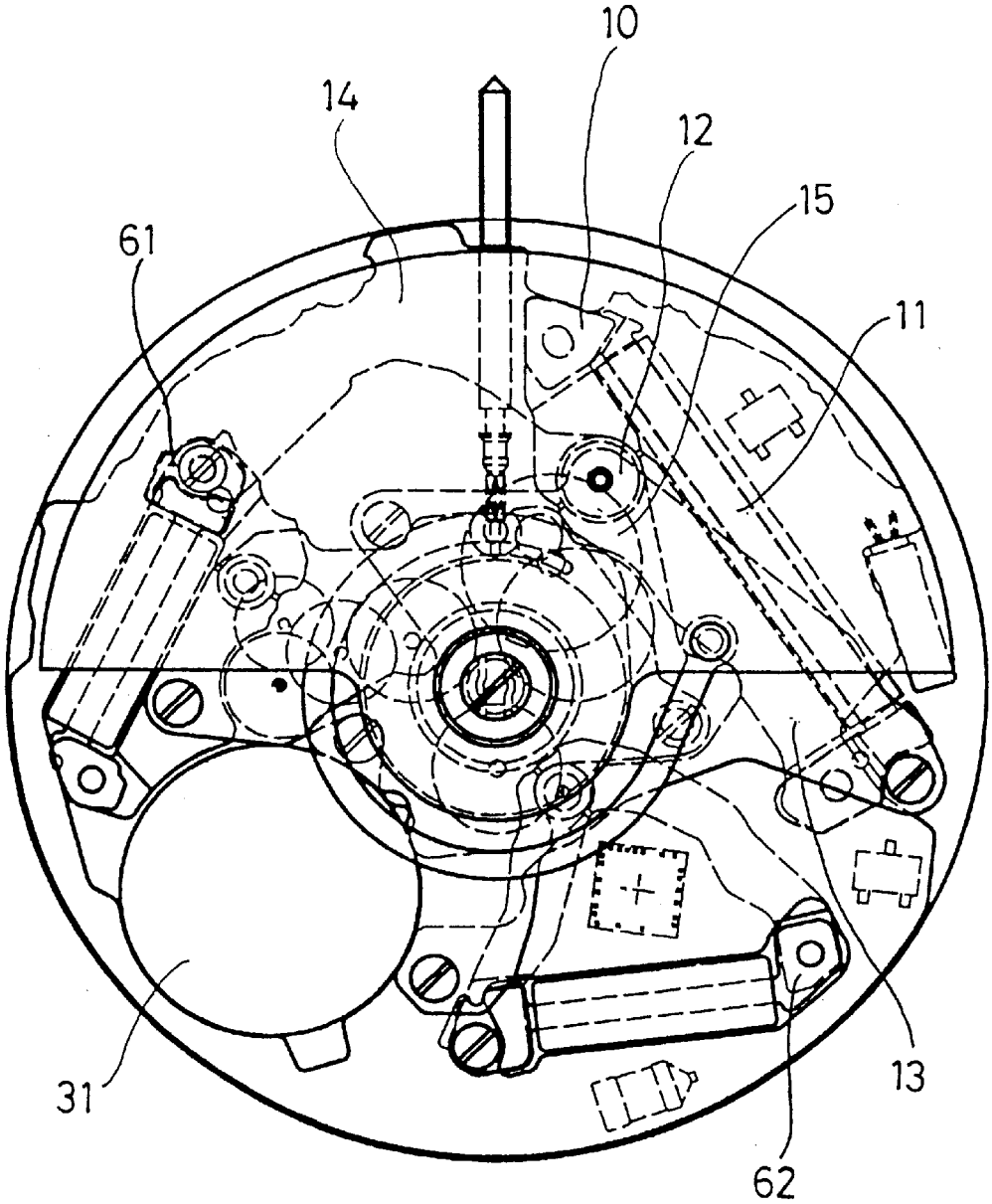
FIG. 3 is a plan view which illustrates in simplified form a specific example of an electronic watch with an electrical generator according to the present invention.
Figure 4:
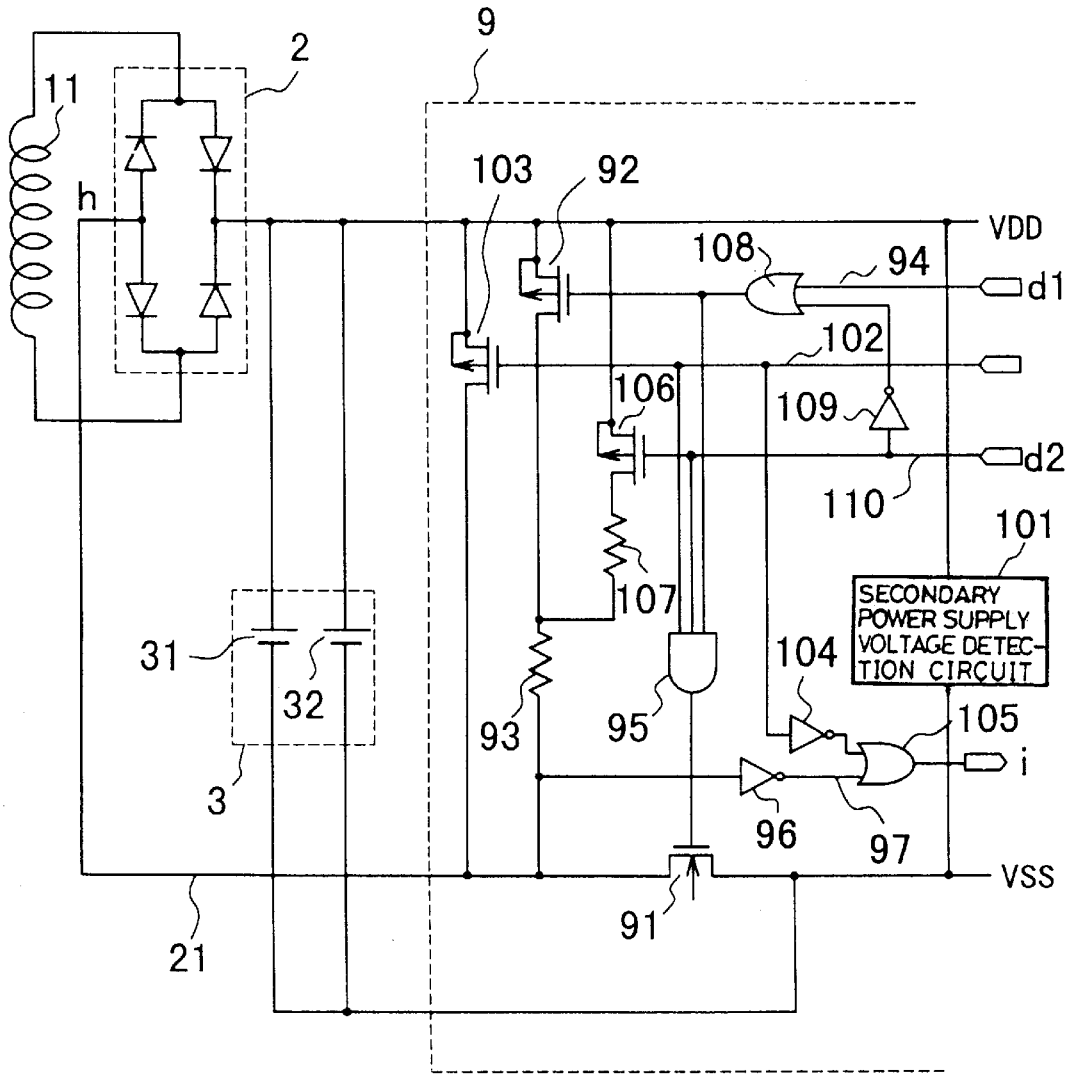
FIG. 4 is a block diagram which illustrates the main part of a specific example of an electronic watch with an electrical generator according to the present invention.

Specifically, as shown in FIG. 1, FIG. 3, and FIG. 4, an electronic watch with an electrical generator according to the second aspect of the present invention is, in an analog-type watch with a load compensation function, having at least two stepping motors that are driven by a prescribed drive pulse, a driving judging means for each of the stepping motors which observes the movement of a rotor after a normal drive pulse is applied to the stepping motor and which judges whether or not each of the stepping motors was driven, and a compensation drive pulse supplying means which, when a judgment is made by the drive judging means that drive had not been done, supplies a compensation drive pulse to a drive circuit, is an electronic watch with an electrical generator, this watch further having an electrical generation-time compensation means that has an electrical generator which operates irregularly and intermittently, an electrical generation detection means which detects the electrical generation action of the electrical generator based on a prescribed relationship with the operation of the drive judging means, and a control means which, when electrical generation action by the electrical generator is detected by the electrical generation detection means, supplies the compensation drive pulse to the drive circuit, regardless of the judgment results of the drive judging means, wherein a first stepping motor and a second stepping motor that are part of the plurality of stepping motors are disposed so as to be at mutually different distances from the electrical generator.

Additionally, in the above-noted example, a first detection sensitivity in the electrical generation detection means that controls the load compensation function means with respect to the first stepping motor for the purpose of detecting the presence or non-presence of electrical generation action in the electrical generator is different from a second detection sensitivity in the electrical generation detection means that controls the load compensation function means with respect to the second stepping motor for the purpose of detecting the presence or non-presence of electrical generation action in the electrical generator.

More specifically, as shown in FIG. 3, of the plurality of stepping motors 61 and 62, the motors are disposed so that a first stepping motor 61, which has a relatively high frequency of usage is disposed at a straight-line distance from the electrical generator 10 that is greater than that of a second stepping motor, which has a relatively low frequency of usage.

By using the above-noted arrangement, in the case in which the first stepping motor 61, which has a high frequency of usage, could not be rotated, it is possible to greatly reduce the opportunity to make a misjudgment as if that the rotor has rotated, by the magnetic noise that is output from the electrical generator 10.

More specifically, it is desirable that the sensitivity for the purpose of detecting the presence or non-presence of electrical generation action of the electrical generator 10 in the electrical generation detection 9 means that controls the load compensation function means 130 with respect to the first stepping motor 61, which is disposed so that its distance from the electrical generator 10 is greater than that of the other motor, the second stepping motor 62, be lower than the sensitivity for the purpose of detecting the presence or non-presence of electrical generation action of the electrical generator 10 in the electrical generation detection means 9 that controls the load compensation function means 130 with respect to the second stepping motor 62.

That is, in this example, the configuration of the electrical generation detection means 9 is made such that the sensitivity of detection of the operation of the electrical generator 10 is different between the case in which operation is made based on a predetermined relationship to the operation of a specific judging means of each of the drive judging means 7, and the case in which operation is made based on a relationship to the operation of the other of the drive judging means 7.

The block diagram of the above-noted example of the present invention is nearly the same as block diagram of the previously described example and, as shown in FIG. 4, there is a slight difference with respect to the configuration which is shown FIG. 2.

As shown in FIG. 3, the configuration of this example is one in which the electronic watch with an electrical generator 40 is formed from one electrical generator 10 and two stepping motors 61 and 62.

In FIG. 1, the alternating current electrical power that is generated by the electrical generator 1, which operates intermittently, is converted to direct current by the rectifying circuit 2 and then charges the secondary power supply 3, this being consumed in driving the other circuits and stepping motors.

The time-keeping circuit 4, is formed by the combination of a quartz resonator element, a frequency divider, and a logic circuit group, this circuit generating and outputting the normal drive pulse a for the stepping motor 6 to the drive circuit 5, in addition to outputting the compensation drive pulse b, the drive coil open/close signal c, the electrical generation detection timing signal d, and other signals such as a clock pulse which are required for control of circuit operation.

In this case, the stepping motor 6 is, as shown in FIG. 3, a time-display stepping motor 61 and a chronograph-display stepping motor 62.

The reference numeral 7 denotes a drive judging means, which is controlled by the drive coil open/close signals c and makes a judgment as to whether or not normal drive was done, according to the magnitude and timing of the induced voltage signal e which is generated upon the receipt by the drive circuit 5 of the movement information f of the rotor of the stepping motor 6 (61 and 62).

In the case in which normal drive was not done, the gate open/close signal g is generated, the compensation drive pulse supplying means 8 is operated, and a compensation drive pulse b is supplied to the drive circuit 5.

The generated voltage signal h from the rectifying circuit 2 is observed by the electrical generation detection circuit 9, and the electrical generation detection signal i that is output when there was electrical generation within a prescribed time period according to the electrical generation detection timing signal d, cancels subsequent operation of the drive judging means 7, and opens the compensation drive pulse supplying means 8 to supply a compensation drive pulse.

The drive circuit 5, drive judging circuit 7, normal drive pulse a, compensation drive pulse b, drive coil open/close signal c, electrical generation detection timing signal d and the like are provided with drive circuit and judging circuits, pulse generation circuits and the like corresponding to each of the stepping motors, each being provided with driving circuit, detection circuit, and detecting pulse generating circuit, respectively.

In a specific circuit, there is no need for each block or signal to be separated, and it is possible for these to be intermingled, this drawing being merely a conceptual drawing. The parts that belong to the blocks numbered 5 through 8 are substantially a configuration that falls within the scope of the technology disclosed as the background art of FIG. 1.

Next, FIG. 4 is a drawing which shows a specific circuit configuration that corresponds to the electrical generator 10, the rectifying circuit 2, the secondary power supply 3 and the electrical generation detection means 9 corresponding to FIG. 1, as the main parts which differ from the background art.

The reference numeral 11 is a coil of the electrical generator 10, the alternating current that is generated by the rotation of the rotor 12 being converted to a pulsating direct current by the rectifying circuit 2.

The positive-voltage side of the direct current output is led the line VDD, and the negative-voltage side is led to within the electrical generation detection circuit 9 via the line 21. The line 21 passes through a current-limiting transistor 91, which is normally switched off during discharging and when detection electrical generation (bulk potential also being switched, this being the potential of line 21 when on and connected to the VSS potential during discharge and when detecting electrical generation), and is then connected to the line VSS, a secondary power supply 3 formed by a secondary cell 31 and a capacitor 32 which are each connected in parallel between the VDD line and the VSS line being charged thereby.

FIG. 2 also shows some circuitry which is not necessarily directly related to the electrical generation detection function. Of this circuitry, 101 is a secondary power supply voltage detection circuit, which monitors the voltage between VSS and VDD.

Should an overcharged condition cause a load signal on the line 102, this signal will close the AND gate 95, thereby turning the current-limiting transistor off, which separates the line 21 from the line VSS, thereby stopping new charging, simultaneously with which the transistor 103, which is connected between the line VDD and the line 21 is caused to conduct, thereby causing discharge of the generated electrical power (the output of the rectifying circuit 2).

The secondary power supply 3 quickly leaves the overcharged condition due to the normal power consumption, the charging path being restored. The secondary power supply voltage detection circuit 101 also exists for the purpose of notifying the user via a change in the display of the insufficient charge condition. However, because this technology has already been established in the past, its description will be omitted herein.

Returning to the operation of detecting electrical generation in this example of the present invention, first the case in which only the stepping motor 61 for time display shown in FIG. 3 operates, the chronograph-display stepping motor 62 not operating, will be described.

In the load compensation function means 130, a single negative pulse (surrounding pulse), which is generated immediately (0.5 ms) before and so as to cover the drive coil open/close signal c (FIG. 1) which is made up of a multitude of strobe pulse groups generated for the purpose of detecting the free vibration of the rotor of the stepping motor 61 is generated.

The electrical generation detection timing pulse d1 is applied to the line 94. This signal passes through an OR gate 108, closes the AND gate 95 and turns the current-limiting transistor 91 off, thereby separating the line 21 from VSS, and also turning the first detection resistance control transistor 92 on, so as to check the potential of the rectifying circuit 2 (and therefore the operation of the electrical generator) as a voltage change across the terminals of the detection resistance 93 that is connected in series therewith, this being a check of the generated voltage signal h.

As a result, a signal that appears at the output line 97 of the detection inverter 96, the input terminal of which is connected to the lower end of the detection resistance 93, is low level when electrical generation does not occur, and high level when electrical generation occurs, the electrical generation detection signal i appearing via the OR gate 105 at the output terminal thereof. The electrical generation detection signal i, as described with regard to FIG. 1, disables the operation of the driving judging means 7 and supplies a compensation drive pulse b to the drive circuit 5.

When the discharging transistor 103 operates under the overcharge condition, the input of the detection inverter 96 is forcibly set to VDD, the result being that even if the electrical generator 1 generates electricity, the output of the detection inverter 96 is low, so that the judgment is that of no electrical generation.

Because of the above, the negative signal that is generated on the line 102 during overcharging is inverted by the inverter 104, and is output as the electrical generation detection signal i via the OR gate 105.

That is, the result is that a compensation drive pulse is always output when overcharging. Naturally, because of this while the power consumption is large, this causes absolutely no problem, because it occurs in a condition when there is an excess of electrical power.

When the electrical generation detection signal i is present, although even after the rotor is fed normally by one step, the compensation drive pulse b will be output, the polarity thereof (direction of the current in the coil) is the same as the normal drive pulse a, and because this is in the reverse direction with respect to the next rotation, rather than drive being done, the rotor simply vibrates, so that the condition in which the rotor is excessively fed by the compensation drive pulse does not occur.

Next the case in which the chronograph-display stepping motor 62 shown in FIG. 3 also starts to operate in accordance with the operation of an external element (not shown in the drawing) will be described.

A single negative pulse (surrounding pulse), which is generated immediately (0.5 ms) before and so as to cover the drive coil open/close signal c (FIG. 1) which is made up of a multitude of strobe pulse groups generated for the purpose of detecting the free vibration of the rotor of the stepping motor 61 is generated, this pulse being the electrical generation detection timing signal d2, which is applied to the line 110.

This signal closes the AND gate 95 and turns the current-limiting transistor 91 off, which separates the line 21 from VSS and also turns the second detection resistance control transistor 106 on. It also passes through the inverter 109 and the OR gate 108 and is applied to the first detection resistance control transistor 92, thereby turning the first detection resistance control transistor 92 off. As a result, the detection resistance 107 and the detection resistance 103 (this two resistances forming the second detection resistance) are connected in series with the second detection resistance control transistor 106, so as to check the generated voltage signal h, which is the rectifying circuit 2 potential (and therefore the operation of the electrical generator) as a potential variation at the other end of the detection resistance 93.

As a result, similar to the above description, the signal that appears at the output of the detection inverter 96 output line 97 is low when electrical generation is not done and high when electrical generation is done, this appearing as the electrical generation detection signal i via the OR gate 105. Similar to the above-noted description of the electrical generation detection signal i, the operation of the driving judging means 7 is disabled, and a compensation drive pulse b is supplied to the drive circuit 5.

Next, the reason for switching the electrical generation detection resistance between the case of operation of only the time-display stepping motor and the case in which the chronograph-display stepping motor 62 also operates will be described.

As shown in FIG. 3, the time-display stepping motor 61 is disposed so as to be relative distance from the electrical generator 10 of the electrical generating mechanism 1, and the chronograph-display stepping motor 62 is disposed to be relatively close to the electrical generator 10.

For this reason, there is a greater tendency for magnetic noise that is generated by electrical generation of the electrical generator 10 to influence the stepping motor 62 which is close to the electrical generator 10. The greater the rpm of the rotor 12, the greater is this influence. In experimentation, it was seen that, whereas false detection occurs in the drive judging means for time display with the rotor 12 of the electrical generator 10 rotating at approximately 28,000 rpm, false detection occurs at approximately 9000 rpm in the driving judging means for the chronograph display.

To prevent such false detection, it is desirable to perform detection of electrical generation that becomes noise at as low a rotor 12 rpm as possible so as to generate the electrical generation detection signal i. However, if the electrical generation detection signal i is generated at too low an rpm, this will itself cause the generation of a compensation drive pulse, thereby resulting in wasteful consumption of power.

Because of the above problem, to provide a safety margin, when the stepping motor 61 operates, it is appropriate to generate the electrical generation detection signal i at a rotor 12 rpm of approximately 22,000 rpm, and when the stepping motor 62 operates, to cause generation of the electrical generation signal i at a rotor 12 rpm of approximately 7,000 rpm.

With regard to the above, the value of the first detection resistance 93 is 400 ‖, and the value of the second detection resistance, which has detection resistance 107 added to the detection resistance 93, is 1900‖, the detection sensitivities being different by virtue of this difference in resistance values.

When the stepping motor 61 operates, the only opportunity for detection of electrical generation by the second detection resistance, for which it is easy to generate the electrical generation detection signal i, is the case in which the electrical generation detection timing signals d1 and d2 overlap.

From the above description, it can be understand that if only the first detection resistance is operated without changing the detection resistance, false detection of stepping motor 62 will occur, this causing disturbance (delay) in the chronograph display, and that if only the second detection resistance is operated the compensation drive pulse b will be frequently generated by the electrical generation detection signal i for the stepping motor 61, this resulting in much wasteful consumption of power.

It can also be understood that, because the time-display stepping motor 61 which is constantly used is disposed farther away from the electrical generator 10 than the chronograph-display stepping motor 62 which has a low frequency of usage, there is little generation of the compensation drive pulse b by the electrical generation detection signal i.

The above has been a description of one aspect of the present invention. A variation of an embodiment of the present invention is described below.

For example, there can be electrical generation by induction from the outside of the watch. There is also no need to restrict the details of the technology used for load compensation to those used in the first and third background arts, and it is possible to impart thereto an arbitrary variation.

For example, it is possible to envision the case in which the normal drive pulse, rather than having a fixed width, has a width which is switched in accordance with frequency of occurrences of misfeeds, the case in which a change is made in the condition for judging a normal drive, for example the number of continuous times N exceeding a threshold value, a plurality of compensation drive pulses being made available, compensation drive being performed that differs depending upon, for example, the load condition and noise condition, or depending excessive load or excessive noise, the case in which sharable circuits are partially shared, or in which a programmable microcomputer is used partially or in whole in place of fixed logic circuits. Additionally, there is no restriction to the use of two motors, it being possible to use three or more motors as well.

The above-noted example of the present invention is an analog-type watch with a load compensation function, having at least two stepping motors that are driven by a drive pulse, a driving judging means for each of the stepping motors which observes the movement of a rotor after a normal drive pulse is applied to the stepping motor and which judges whether or not each of the stepping motors was driven, and a compensation drive pulse supplying means which, when a judgment is made by the drive judging means that drive had not been done, supplies a compensation drive pulse to a drive circuit, this watch further having an electrical generator capable of operating intermittently, an electrical generation detection means which detects the electrical generation by the electrical generator 1, based on a prescribed relationship to the operation of the driving judging means, and a electrical generation-time compensation means which, when electrical generation by the electrical generator is detected by the electrical generation detection means, supplies a compensation drive pulse, giving priority to the judgment of the driving judging means, and a detection sensitivity switching means whereby the sensitivity of detection of electrical generation is switched so that it is different between the case in which the operation of detecting the electrical generation of the electrical generator is made based on a relationship to the operation of a specific judging means of each of the drive judging means, and the case in which operation is made based on a relationship to the operation of the other of the drive judging means.

The detection sensitivity in the separate electrical generation detection means 9 which are used in the above example are preferably configured to allow switching thereof by an appropriate switching means.

Additionally, in an electronic watch with an electrical generator 40 which has a load compensation function 130 according to the present invention, which has at least two stepping motors 61 and 62, which are driven by a prescribed drive pulse, a drive judging means for each stepping motor which, immediately after application of a normal drive pulse to the stepping motors 61 and 62, judges whether or not the stepping motor has been driven by observing the movement of the rotor thereof, and a compensation drive pulse supplying means 8 which, a judgment is made by the driving judging means that the prescribed drive was not done, supplies a compensation drive pulse b corresponding to each of the stepping motors 61 and 62, it is preferable that the watch have an electrical generation-time compensation means 121 which has an electrical generator 10 capable of intermittent operation, an electrical generation detection means which detects the electrical generation of the electrical generator 10, based on a prescribed relationship to the operation of the driving judging means 7, and a control means 120 which, when electrical generation of the electrical generator 10 is detected by the electrical generation detection means 9, supplies a compensation drive pulse b to the drive circuit 5, regardless of the judgment results of the driving judging means 7, and that it be configured so that the detection sensitivity with respect to the electrical generator 10 is caused to be different between the case in which the electrical generation detection means 9 operates based on a prescribed relationship to the operation of a particular driving judging means 7 of the driving judging means 7, and the case in which it operates based on a prescribed relationship to the operation of a different driving judging means 7.

According to the present invention, an electrical generation detection means and a driving judging means are caused to operate in parallel, so that a compensation drive pulse is supplied when electrical generation is detected, so that when a different stepping motor operates the detection sensitivity of the electrical generation detection means is caused to be switched, the result being the elimination of the possibility of generating a false drive judgment caused by noise, an improvement in the watch display reliability by assuring load compensation operation, and the achievement of a electronic watch with an electrical generator which has small power consumption in normal operation.

What is claimed is:

1. An electronic watch with an electric generator and which further comprising a load compensation function, having a stepping motor which is driven by a prescribed drive pulse, a driving judging means which observes a movement of a rotor after a normal drive pulse is applied to said stepping motor and which judges whether or not drive was done, and a compensation drive pulse supplying means which, when a judgment is made by said driving judging means that said prescribed drive had not been done, supplies a compensation drive pulse to a drive circuit, said watch further comprising an electrical generation-time compensation means, which comprises:

an electrical generator capable of irregularly intermittent operation;

means for detecting electrical generation by said electrical generator, based on a prescribed relationship to operation of said driving judging means; and a control means which, when said electrical generation detection means detects electrical generation by said electrical generator, supplies said compensation drive pulse to said drive circuit, regardless of judgment results of said driving judging means.

2. An electronic watch with an electric generator and which further comprising a load compensation function, according to claim 1, wherein an output of said control means of said electrical generation-time compensation means controls said compensation drive pulse supplying means.

3. An electronic watch with an electric generator and which further comprising a load compensation function, according to claim 2, wherein an output of said control means of said electrical generation-time compensation means controls said compensation drive pulse supplying means so that said compensation drive pulse is supplied to said drive circuit, with priority given to a judgment of said driving judging means.

4. An electronic watch with an electric generator and which further comprising a load compensation function, according to any one of claim 1 through claim 3, wherein a period of time of operation of said electrical generation detection means is made to be nearly coincidental with a period of time of operation of said driving judging means.

5. An electronic watch with an electric generator and which further comprising a load compensation function, according to claim 4, wherein in a case in which said electrical generation detection means detects operation of said electrical generator, said electrical generation-time compensation means causes operation of said driving judging means to stop.

6. An electronic watch with an electric generator and which further comprising a load compensation function, according to claim 1, wherein by controlling said compensation drive pulse supplying means said electrical generation-time compensation means causes a compensation drive pulse supplied by said load-compensation function means to be equal to a compensation drive pulse supplied when electrical generation is detected.

7. An electronic watch with an electric generator and which further comprising a load compensation function, according to claim 1, wherein said electrical generation detection means judges whether or not a value of a rectified direct current from an alternating current voltage that is generated by said electrical generator exceeds a priorly established threshold value so as to detect the presence or non-presence of electrical generation by said electrical generator.

8. An electronic watch with an electric generator and which further comprising a load compensation function, according to claim 7, wherein a detection sensitivity in said electrical generation detection for the purpose of detecting the presence or non-presence of electrical generation by said electrical generator is priorly established as a prescribed sensitivity.

9. An electronic watch with an electric generator and which further comprising a load compensation function, according to claim 8, wherein said sensitivity in said electrical generation detection means can be adjustably set.

10. An electronic watch with an electric generator and which further comprising a load compensation function, according to claim 1, wherein said compensation drive pulse supplying means comprises a gate switch.

11. An electronic watch with an electric generator and which further comprising a load compensation function, according to claim 1, wherein a plurality of stepping motors driven by said prescribed drive pulse are provided.

12. An electronic watch with an electric generator and which further comprising a load compensation function, according to claim 11, wherein part of said plurality of stepping motors is disposed at an distance from said electrical generator that is different from another stepping motor.

13. An electronic watch with an electric generator and which further comprising a load compensation function, according to claim 11, wherein the detection sensitivity with respect to the presence of electrical generation by said electrical generator in said electrical generation detection means that controls a load compensation function for one part of said stepping motors, is different from the detection sensitivity with respect to the presence of electrical generation by said electrical generator in said electrical generation detection means that controls a load compensation function for other part of said stepping motors.

14. An electronic watch with an electric generator and which further comprising a load compensation function, according to claim 12, wherein, of said plurality of stepping motors, a stepping motor having a relatively high frequency of usage is disposed so as to be at a greater distance from said electrical generator than another stepping motor that has a relatively low frequency of usage.

15. An electronic watch with an electric generator and which further comprising a load compensation function, according to claim 14, wherein the detection sensitivity for detecting the presence of electrical generation by said electrical generator in said electrical generation detection means that controls said load compensation function means for a stepping motor that is disposed so as to be more distant from said electrical generator than other stepping motors is made to be lower than the detection sensitivity for detecting the presence of electrical generation by said electrical generator in said electrical generation detection means that controls said load compensation function means for a different stepping motor.

16. An electronic watch with an electric generator and which further comprising a load compensation function, according to claim 12, wherein said separate detection sensitivities can be switched via a switching means.

17. An electronic watch with an electric generator and which further comprising a load compensation function, according to claim 1, said watch further comprising means for storing electrical power generated by said stepping motor and means observing a voltage of said storage means, wherein in a case in which a priorly established voltage value is reached or exceeded, a compensation drive pulse is output, regardless of the presence or non-presence of an electrical generation detection signal.

18. An electronic watch with an electric generator and which further comprising a load compensation function, according to claim 17, said watch further comprising a voltage detection means for said storage battery and an overcharging prevention means which, when detection is made that the voltage of said storage battery detected by said voltage detection means equals to or exceeds a priorly established voltage value stops charging of said storage battery.

19. An analog-type watch with an electric generator means and which further comprising a load compensation function, and which having at least two stepping motors that are driven by a prescribed drive pulse, a driving judging means for each of said stepping motors which observes the movement of a rotor after a normal pulse is applied to said stepping motor and which judges whether or not each of the stepping motors was driven, and a compensation drive pulse supplying means which, when a judgment is made by said driving judging means that drive had not been done, supplies a compensation drive pulse to a drive circuit, which corresponds to each one of said step motors, said watch further comprising an electrical generation-time compensation means that has an electrical generator which irregularly operates intermittently, an electrical generation detection means which detects an electrical generation action of said electrical generator based on a prescribed relationship with the operation of said driving judging means, and control means which, when electrical generation operation by said electrical generator is detected by said electrical generation detection means, supplies a compensation drive pulse to said drive circuit, regardless of the judgement resulted from said driving judging means, wherein said electrical generation detection means is configured so that detection sensitivity with respect to operation of said electrical generator is different between the case of operation based on a prescribed relationship to operation of a specific driving judging means of said driving judging means and operation based on a prescribed relationship to operation of a different driving judging means.

* * * * *

UNITED STATES PATENT AND TRADEMARK OFFICE

CERTIFICATE OF CORRECTION

PATENT NO. : 6,021,097
DATED : February 1, 2000
INVENTOR(S) : Kanno et al.

Figures 12, 12H:
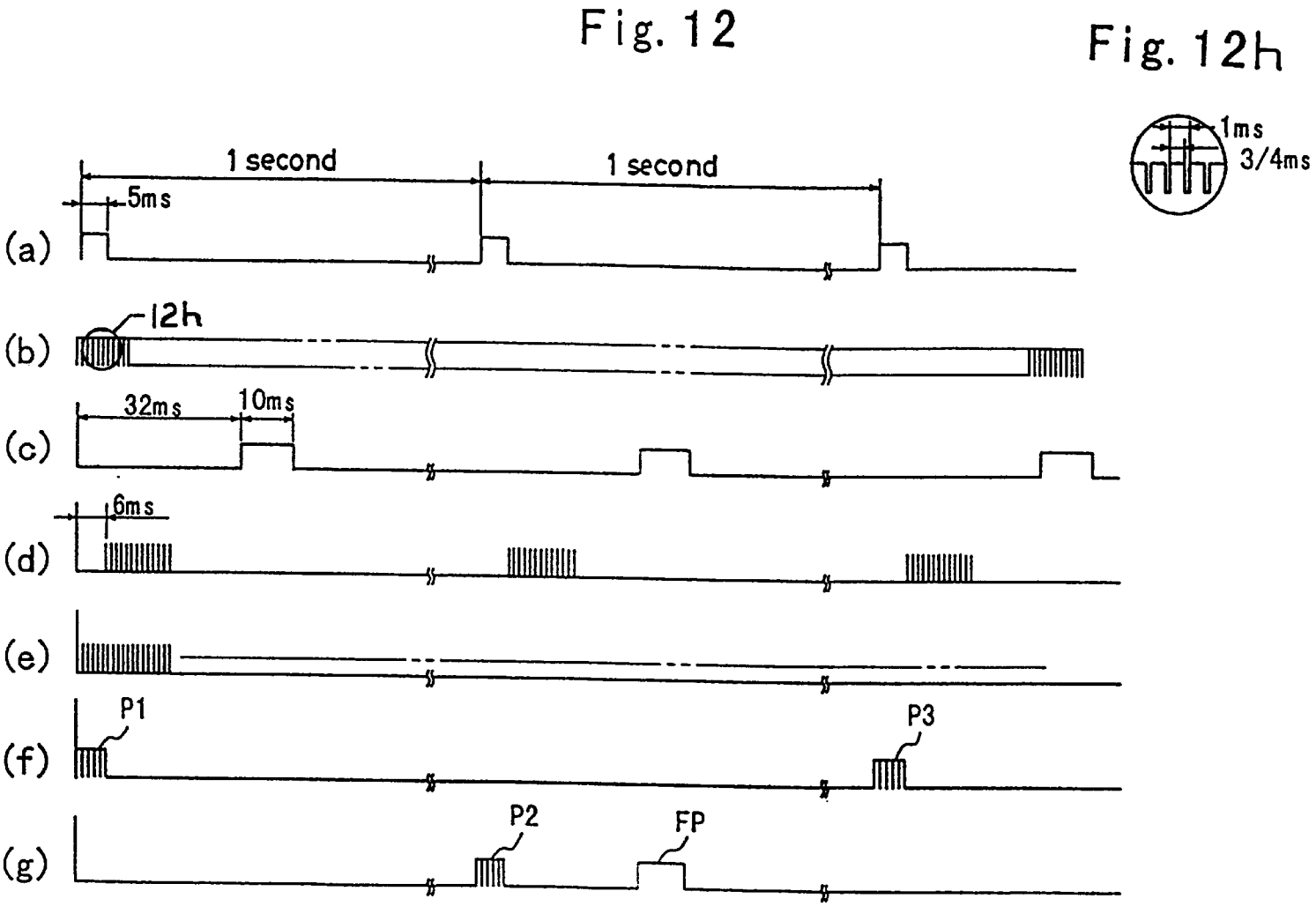
FIG. 12 is a timing chart related to the background art.

It is certified that error appears in the above-identified patent and that said Letters Patent is hereby corrected as shown below:

Title page:

Under "[57] Abstract" please delete the existing Abstract, and insert as follows-- An analog-type electronic with an electrical generating apparatus is provided for a watch having a load compensation function means which avoids the adverse influence of magnetic noise from electrical generation. The electrical generator operates intermittenty, and an electrical generation detection means detects electrical generation by the electrical generator based on a prescribed relationship with a drive judging means. A control means supplies a compensation drive pulse to a drive circiut when the drive judging means detects electrical generation regardless of the judgement results of the drive judging means. -- therefor Column 1,
Line 6, before " electrical" delete "a" and insert -- an -- therefor:

Column 2,
Line 12, delete "voltages waves" and insert -- voltage frequency -- therefor
Line 22, delete "(d), Fig. 12(d)" and insert -- (b), Fig.12(b) therefor;
Line 29, delete "on same times";
Line 35, delete "on some time.
Line 42, delete "©, Fig. 12©" and insert -- (b), Fig. 12(b) -- therefor;
Line 50, after "drive" insert -- ; -- (comma) ;
Line 64, before "case" insert -- the -- ;

Column 3,
Line 12, before "judging" insert -- the -- ;
Line 28, after "wristwatch" insert -- , -- , (comma) ;

Column 4,
Line 36, delete "cause" and insert -- caused -- therefor,

Column 5,
Line 45, delete comprising" and insert -- includes -- therefor;
Line 54, delete "circuit, the" and insert -- circuit. The -- therefor;

Column 6,
Line 20, delete "resulted" and insert -- resulting -- therefor;
Line 57, delete "a graphs which shows" and insert -- graphs which show -- therefor

UNITED STATES PATENT AND TRADEMARK OFFICE

CERTIFICATE OF CORRECTION

PATENT NO. : 6,021,097
DATED : February 1, 2000
INVENTOR(S) : Kanno et al.

It is certified that error appears in the above-identified patent and that said Letters Patent is hereby corrected as shown below:

Column 7,
Line 36, before "main" insert -- a -- ;
Line 54, delete "a"and insert -- an -- therefor;

Column 8,
Line 1, delete "a" and insert -- an -- therefor;
Line 7, delete "clear" and insert -- clearly -- therefor;

Column 9,
Line 15, after "motor 6" and insert -- ; -- (comma)

Column 10,
Line 6, delete "disable" and insert -- disables -- therefor;
Line 34, delete "a" and insert -- an -- therefor;
Line 47, delete "watching" and insert -- watch -- therefor;
Line 51, delete "a"and insert -- an -- therefor;
Line 63, delete "bring" and insert -- placing -- therefor;
Line 66, delete "en" and insert -- an -- therefor Column 11,
Line 8, delete "a"and insert -- an -- therefor
Line 37, delete "on" and insert -- an -- therefor;
Line 38, before "judges" insert -- it --

Column 12,
Line 3, delete "be" and insert -- have -- therefor;
Line 14, delete "exceeding" and insert -- exceeds -- therefor;
Line 18, after "depending" insert -- on -- ;
Line 22, before "object" insert -- an -- ;

Column 13,
Line 2, delete "observes" and insert -- observe -- therefor;
Line 35, after "usage" insert -- , -- (comma) ;
Line 44, delete "that" (first occurrence);

Column 14,
Line 53, before "driving" insert -- a -- ,

Column 15
Line 50, before "is generated" insert -- , -- , (comma) ;

UNITED STATES PATENT AND TRADEMARK OFFICE

CERTIFICATE OF CORRECTION

PATENT NO. : 6,021,097
DATED : February 1, 2000
INVENTOR(S) : Kanno et al.

It is certified that error appears in the above-identified patent and that said Letters Patent is hereby corrected as shown below:

Column 16,
Line 39, after "61" insert -- , -- (comma);
Line 50, delete "this" and insert -- these -- therefor;

Column 17,
Line 5, before "distance" insert -- in -- ;
Line 35, delete "11" and insert -- Ω -- therefor,
Line 37, delete "11" and insert -- Ω -- therefor;
Line 55, after "61" insert -- , -- (comma);
Line 55, after "used" insert -- , -- (comma);
Line 57, after "62" insert -- , -- (comma);

Column 18,
Line 34, delete "a" insert -- an -- ;
Line 60, before "a" insert -- when -- ;

Column 19,
Line 24, delete "a"and insert -- an -- therefor
Line 29, delete "which"
Line 31 delete "driving" and insert -- drive -- therefor
Line 35, delete "driving" and insert -- drive -- therefor
Line 44, delete "driving"and insert -- drive -- therefor
Line 49, delete "driving" and insert -- drive -- therefor
Line 50, delete "and which"
Line 56, delete "and which"
Line 64, delete "and which"

Column 20,
Line 2, delete "driving" and insert-- drive -- therefor
Line 3, delete "and which"
Line 8, delete "driving"and insert-- drive -- therefor
Line 10, delete "and which"
Line 18, delete "and which"
Line 26, delete "and which"
Line 33, delete "and which"
Line 37, delete "and which"
Line 41, delete "and which"
Line 45, delete "and which"
Line 50, delete "and which"
Line 61, delete "and which"

UNITED STATES PATENT AND TRADEMARK OFFICE

CERTIFICATE OF CORRECTION

PATENT NO. : 6,021,097
DATED : February 1, 2000
INVENTOR(S) : Kanno et al.

It is certified that error appears in the above-identified patent and that said Letters Patent is hereby corrected as shown below:

Column 21,
Line 1, delete "and which"
Line 13, delete "and which"
Line 17, delete "and which"
Line 26, delete "and which"
Line 26, delete "and which"

Column 22,
Line 2, delete "and which"
Line 2, delete "which"
Line 4, delete "driving"and insert-- drive -- therefor
Line 11, delete "driving"and insert -- drive -- therefor
Line 19, delete "driving"and insert -- drive -- therefor
Line 24, delete "driving"and insert -- drive -- therefor
Line 28, delete "driving"and insert-- drive -- therefor
Line 29, delete "driving"and insert-- drive -- therefor; and
Line 30, delete "driving"and insert -- drive -- therefor.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*